US009303503B2

(12) United States Patent
Ramsey et al.

(10) Patent No.: US 9,303,503 B2
(45) Date of Patent: Apr. 5, 2016

(54) THREE-PHASE SEPARATION DOWNHOLE

(76) Inventors: Michael C. Ramsey, The Woodlands, TX (US); Michael L. Finley, Nacogdoches, TX (US)

( * ) Notice: Subject to any disclaimer, the term of this patent is extended or adjusted under 35 U.S.C. 154(b) by 1683 days.

(21) Appl. No.: 12/449,441

(22) PCT Filed: Feb. 8, 2008

(86) PCT No.: PCT/US2008/001698

§ 371 (c)(1),
(2), (4) Date: Aug. 7, 2009

(87) PCT Pub. No.: WO2008/100429

PCT Pub. Date: Aug. 21, 2008

(65) Prior Publication Data

US 2011/0024110 A1 Feb. 3, 2011

(51) Int. Cl.
*E21B 43/40* (2006.01)
*E21B 43/38* (2006.01)

(52) U.S. Cl.
CPC ..... *E21B 43/385* (2013.01)

(58) Field of Classification Search
CPC ..... E21B 43/385
USPC ..... 166/265, 105.5, 68, 106
See application file for complete search history.

(56) References Cited

U.S. PATENT DOCUMENTS

| | | | | |
|---|---|---|---|---|
| 2,906,210 | A | 9/1959 | Mason | |
| 5,450,897 | A | 9/1995 | Brown | |
| 5,996,690 | A * | 12/1999 | Shaw et al. | 166/250.01 |
| 6,082,452 | A * | 7/2000 | Shaw et al. | 166/105.5 |
| 6,196,313 | B1 | 3/2001 | Simons | |
| 6,336,503 | B1 * | 1/2002 | Alhanati et al. | 166/265 |
| 6,547,003 | B1 * | 4/2003 | Bangash et al. | 166/106 |
| 6,550,535 | B1 | 4/2003 | Traylor | |
| 2001/0013412 | A1 | 8/2001 | Tubel | |
| 2006/0027362 | A1 | 2/2006 | Cognata | |

* cited by examiner

*Primary Examiner* — Robert E Fuller
(74) *Attorney, Agent, or Firm* — John R Casperson

(57) ABSTRACT

Three-phase separation is achieved downhole in a production well by forming an oil/liquid separation zone in the well between two packers which are positioned between producing and disposal zones. Gas is permitted to separate above the top packer. A pump is used to pump an oil/water mixture from above the top packer into the separation zone. Adequate residence time is permitted in the separation zone to achieve the separation. A check valve in the bottom packer is used to provide pressure to raise the oil to the wellhead. A control valve at the wellhead is used to control pressure in the separation zone and the relative sizes of the streams issuing therefrom.

8 Claims, 10 Drawing Sheets

THREE-PHASE SEPARATION DOWNHOLE

TECHNICAL FIELD

This invention relates to separating three phases downhole, for example, oil, gas and water, and producing separate streams of each.

BACKGROUND ART

The disclosures of Michael et al, U.S. Pat. No. 7,150,315, issued Dec. 19, 2006, and Cognata, US 2006/0027362, published Feb. 9, 2006, now U.S. Pat. No. 7,255,167 issued Aug. 14, 2007 are incorporated by reference herein.

Hydrocarbon producing wells often produce mixtures of oil, gas and water. The water must be safely disposed of. Often, it is stored in surface tankage on the wellsite and trucked away to a disposal well. The procedure causes great expense, and can cause the well to be shut in if the amount of hydrocarbons being produced does not generate sufficient profits to cover the expense of water disposal. The heavy trucks involved also damage the secondary roads often found in oil and gas producing areas.

There is a need for a system to reduce the amount of water which is produced at the wellhead.

It is an object of this invention to provide a well production system in which three-phase well fluids which enter the well downhole are separated downhole into three separate phases.

It is another object of this invention to provide a well production system in which a separated water phase is injected into a disposal zone downhole without ever being produced on the surface of the wellsite.

It is another object of this invention to provide a well production control system to insure that the produced oil stream at the wellhead contains only minor amounts of water and that the water disposal stream downhole contains only minor amounts of oil.

DISCLOSURE OF INVENTION

One embodiment of the invention provides a method for controlling the degree of oil/water separation achieved in a process for separating oil/water/gas phases downhole. A mixture of oil, gas and water is produced in a first section of a cased well. The gas is separated from the mixture and withdrawn from an upper end of the first section. A mixture of oil and water is collected at a lower end of the first section. The collected mixture of oil and water is pumped from the lower end of the first section into a second section positioned beneath the first section. In the second section, the oil phase is separated from the water phase. The second section is maintained at adequate pressure to flow the oil phase to the wellhead and the oil phase flows up a tubing to the wellhead to produce the oil. The produced oil is analyzed for entrained water droplets. An electronic signal representative of the amount of water in the produced oil is produced. A valve operably associated with the tubing is then manipulated responsively to the electronic signal to maintain the amount of water in the produced oil within predetermined lower and upper limits.

Another embodiment of the invention provides a technique for controlling the pressure available downhole to produce the oil phase from an oil/gas/water separation conducted downhole. A mixture of oil, gas and water is produced in a first section of a cased well. The gas is separated from the mixture, the separated gas is withdrawn from an upper end of the first section, and a mixture of oil and water is collected at a lower end of the first section. The collected mixture of oil and water is pumped from the lower end of the first section into a second section positioned beneath the first section. A valve is positioned at the lower end of the second section. The valve is set to provide adequate pressure in the second section to flow the oil phase to the wellhead.

The oil phase is separated from the water phase in the second section and flowed up the tubing to the wellhead where it is produced.

Another embodiment of the invention provides a method for facilitating oil/water separation in an oil/gas/water separation conducted downhole. A mixture of oil, gas and water is produced in a first section of a cased well. The gas is separated from the mixture and the separated gas is withdrawn from an upper end of the first section. A mixture of oil and water is collected at a lower end of the first section. The collected mixture of oil and water is pumped from the lower end of the first section into a second section positioned beneath the first section. In the second section the oil phase is separated from the water phase. The improvement is to establish an environment in the second section to facilitate phase separating the oil phase from the water phase.

In a further embodiment of the invention, there is provided an apparatus for the production of hydrocarbons. A wellbore is provided extending into the earth from a wellhead positioned at the surface of the earth. A casing defined by a tubular casing sidewall lines the wellbore. A set of production perforations extend though the casing sidewall at a first longitudinal position and establish communication between a hydrocarbon production zone and an inside of the casing. A set of disposal perforations extend through the casing sidewall at a second longitudinal position establishing communication between an inside of the casing and a waste water disposal zone. The set of production perforations is spaced apart from the set of disposal perforations and is positioned between the set of disposal perforations and the wellhead. A pump assembly is positioned inside of the casing and sealed against the tubular casing sidewall at a seal location between the first set of perforations and the second set of perforations. The pump assembly has an intake positioned to draw fluid from the inside of the casing above the seal location and a discharge to discharge fluid into the inside of the casing below the seal location. A packer is positioned inside of the casing between the pump assembly and the disposal perforations. The packer has a passage extending through it. A separation chamber is defined in the casing between the pump and the packer. A first valve is operatively associated with the passage extending through the packer. A tubing extends from an upper end of the separation chamber to the wellhead. The tubing forms a flow path between the separation chamber and the wellhead. A second valve is operatively associated with the tubing. The apparatus can be used for carrying out the methods as described above.

BEST MODE FOR CARRYING OUT THE INVENTION

Figure 1A:
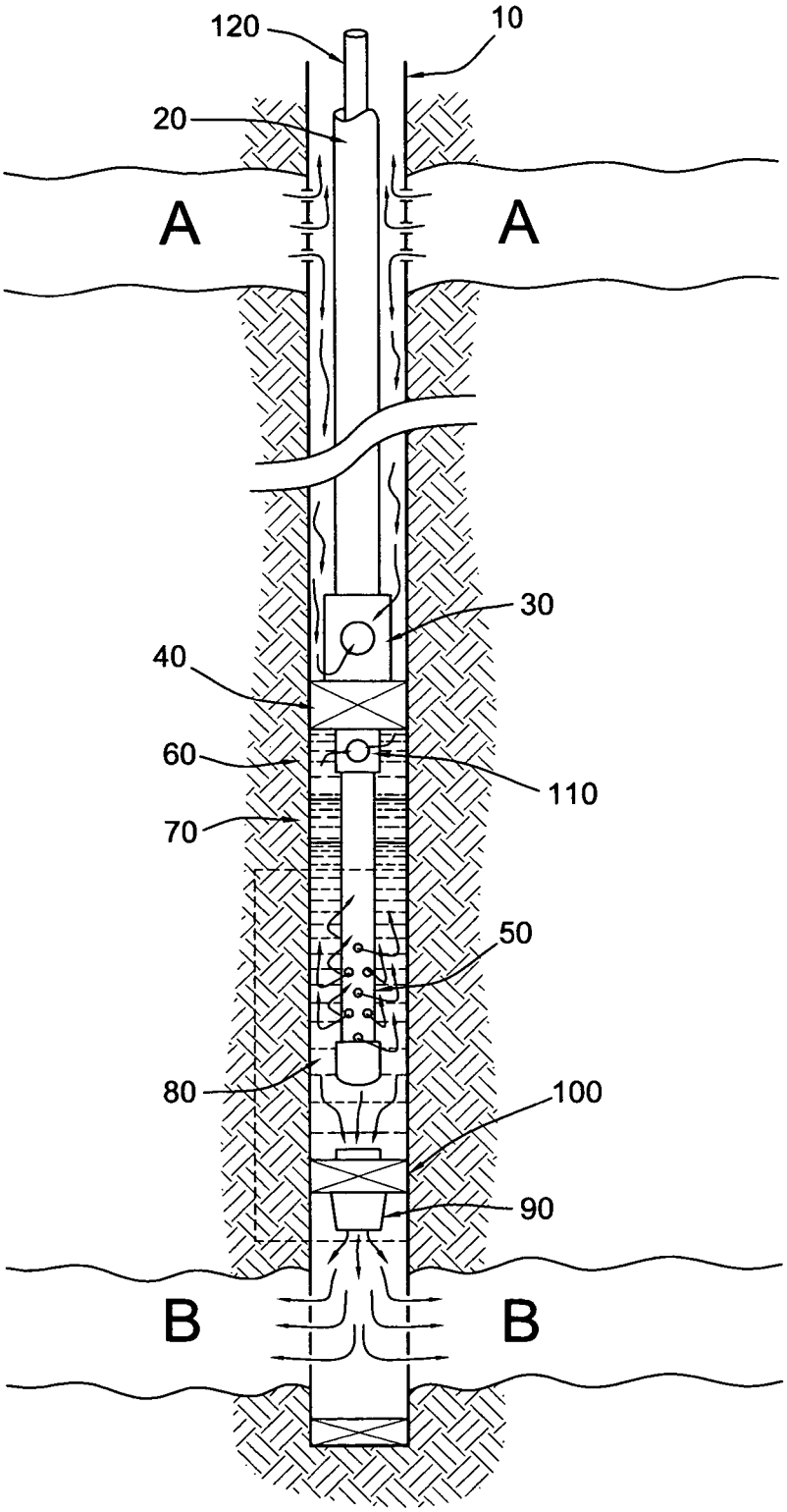
FIG. 1*a* schematically shows an overview of one system according to the invention.

In one embodiment of the invention, there is provided an apparatus for the production of hydrocarbons. A wellbore 11 is provided extending into the earth from a wellhead positioned at the surface of the earth. A casing 10 defined by a tubular casing sidewall lines the wellbore. A set of production perforations 31 extend though the casing sidewall at a first longitudinal position and establish communication between a hydrocarbon production zone A and an inside of the casing. A set of disposal perforations 41 extend through the casing sidewall at a second longitudinal position establishing communication between an inside the casing and a waste water disposal zone B. The set of production perforations is spaced apart from the set of disposal perforations and is positioned between the set of disposal perforations and the wellhead. A pump assembly 25 is positioned inside of the casing and sealed against the tubular casing sidewall at a seal location 40 between the first set of perforations and the second set of perforations. The pump assembly has an intake 30 positioned to draw fluid from the inside of the casing above the seal location and a discharge 50 to discharge fluid into the inside of the casing below the seal location. A packer 100 is positioned inside of the casing between the pump assembly and the disposal perforations. The packer has a passage extending through it. A separation chamber D is defined in the casing between the pump and the packer. A first valve 90 is operatively associated with the passage extending through the packer. A tubing 120 extends from an upper end of the separation chamber to the wellhead. The tubing forms a flow path between the separation chamber and the wellhead. A second valve 105 is operatively associated with the tubing.

In a preferred embodiment of the invention, a control system 175 is operatively associated with the second valve for opening the second valve in response to a decrease in water concentration in fluid carried by the tubing and closing the second valve in response an increase in water concentration in fluid carried by the tubing.

The first valve 90 preferably unseats in response to a pressure difference across the first valve for flow from the separation chamber. If desired, a coagulation media can be positioned in the second chamber.

The pump assembly 25 preferably comprises an outer housing 20, a pump traveling barrel 33, and a pump pull rod 102. The outer housing is positioned in the well casing 10, an annulus 21 being defined between the well casing and the outer housing. The pump traveling barrel is positioned in the outer housing and has an upper end and a lower end. The pump traveling barrel is partly closed at its upper end by an annular wall 67. The pump pull rod has a portion positioned in the pump traveling barrel and a portion extending from the upper end of the pump traveling barrel. The pump pull rod has a lower end and a radially outwardly extending wall 69 from its lower end which seals against the annular wall at the upper end of the pump traveling barrel when the pump pull rod is pulled upwardly. The pump pull rod further has at least one radial outward protrusion spaced apart from its lower end to urge the traveling barrel downwardly. A first pump chamber 76 is defined inside of the traveling barrel and a second pump chamber 79 is defined outside of the pump traveling barrel between an upper end of the pump traveling barrel and an upper end of the outer housing, an annulus for downflow of fluid being defined between the outside of the traveling barrel and the inside of the outer housing. Upstroke on the pull rod expands the first pump chamber and draws fluid in through the pump intake, while simultaneously compressing the second pump chamber and forcing fluid down the annulus between the outside of the traveling barrel and the housing and out the pump discharge E.

In the illustrated embodiment, the pump assembly comprises a second packer 40 sealed against the tubular casing sidewall and a bottom seal manifold 30 carried by the second packer. The bottom seal manifold defines both the pump intake and the pump discharge ports. An axial pull tube 11 extends upwardly from the bottom seal manifold. An inside of the axial pull tube is in flow communication with the pump intake. The axial pull tube has an upper end forming a valve face and at least one radial port 66 spaced apart from the upper end forming a flow path between the inside of the axial pull tube and an annulus between the outside of the axial pull tube and the inside of the pump traveling barrel. An annular seal 77 is mounted to an outside surface of the axial pull tube slidably sealingly engaged with an inner surface of the pump traveling barrel. An annular standing valve 44 is mounted to an inside of the pump traveling barrel for sealing against the valve face at the upper end of the axial pull tube when the pump traveling barrel is urged down.

Preferably, a drop tube 50 extends downwardly from the bottom seal manifold in flow communication with the pump discharge. The drop tube forms a discharge into the separation zone. Also, the tubing 120 extending from an upper end of the separation chamber to the wellhead is preferably located along an axis of the wellbore.

Figure 1B:
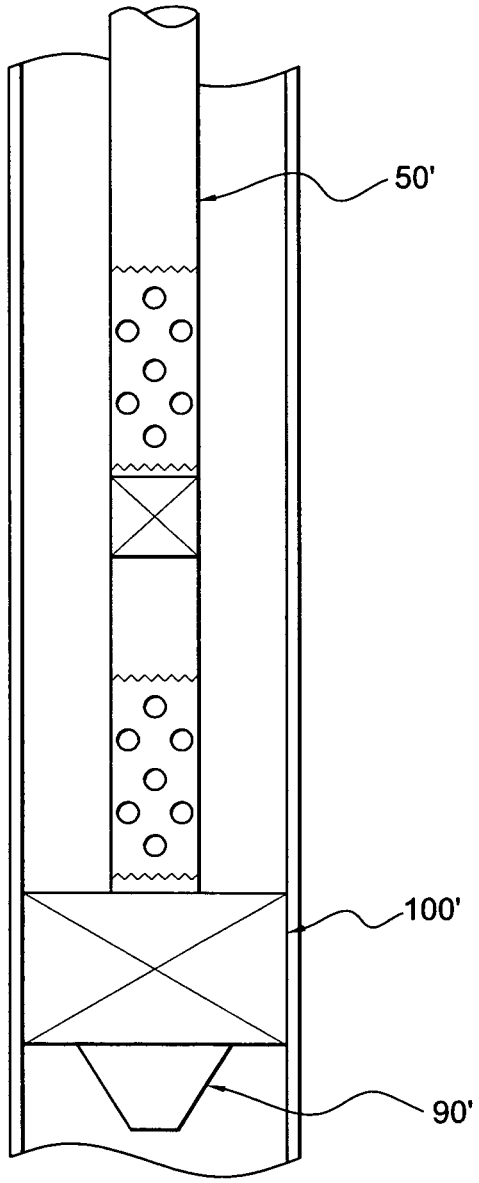
FIG. 1*b* schematically shows an alternative portion to a FIG. 1*a* system.

FIG. 1 is an overview of the invention. The invention is applicable to a production well having a suitable producing zone separated a distance above a suitable disposal zone. The well is cased in the usual way. Casing perforations establish flow communication with the producing zone. Casing perforations are provided to establish flow communication with the disposal zone.

A packer 40 separates the producing zone from the disposal zone. The casing contains adequate volume between the producing zone and the packer 40 to permit any gases introduced into the casing from the producing zone to separate from any liquids introduced into the casing from the producing zone. If desired, emulsion breaking chemicals can be introduced into the volume to facilitate oil/water phase separation in the oil/water separation chamber situated beneath the packer 40.

A pump 20 is mechanically attached to the packer 40. Although electric pumps could be employed in the invention, a mechanical pump is preferred, to reduce shear which contributes to emulsification. The pump is preferably operated by a sucker rod string extending from a motor at the wellhead. The power stroke is preferably the upstroke, to avoid excessive wear or possible buckling of the sucker rod string.

Figure 4A:
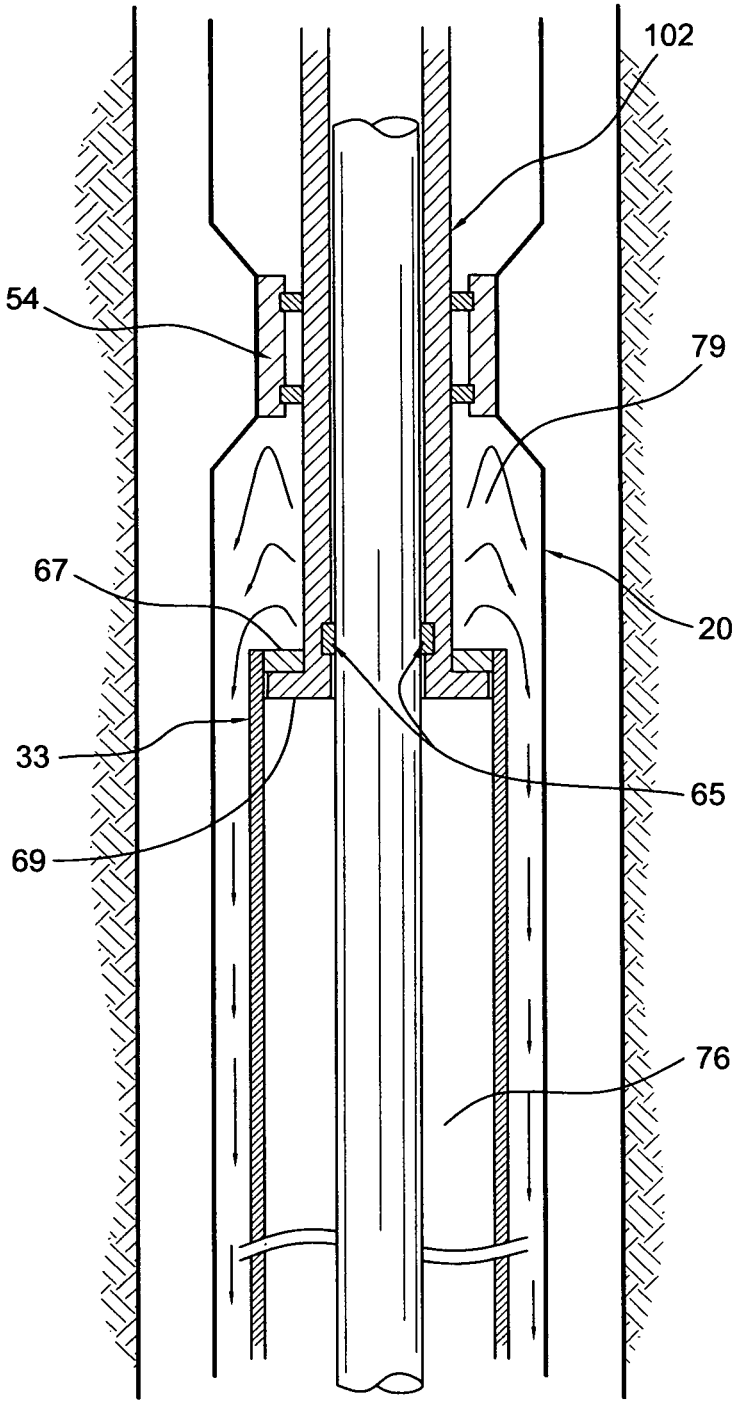
FIG. 4*a* schematically shows additional details of a portion of a pump as shown in FIGS. 2-3 and 4*b*.
Figure 4B:
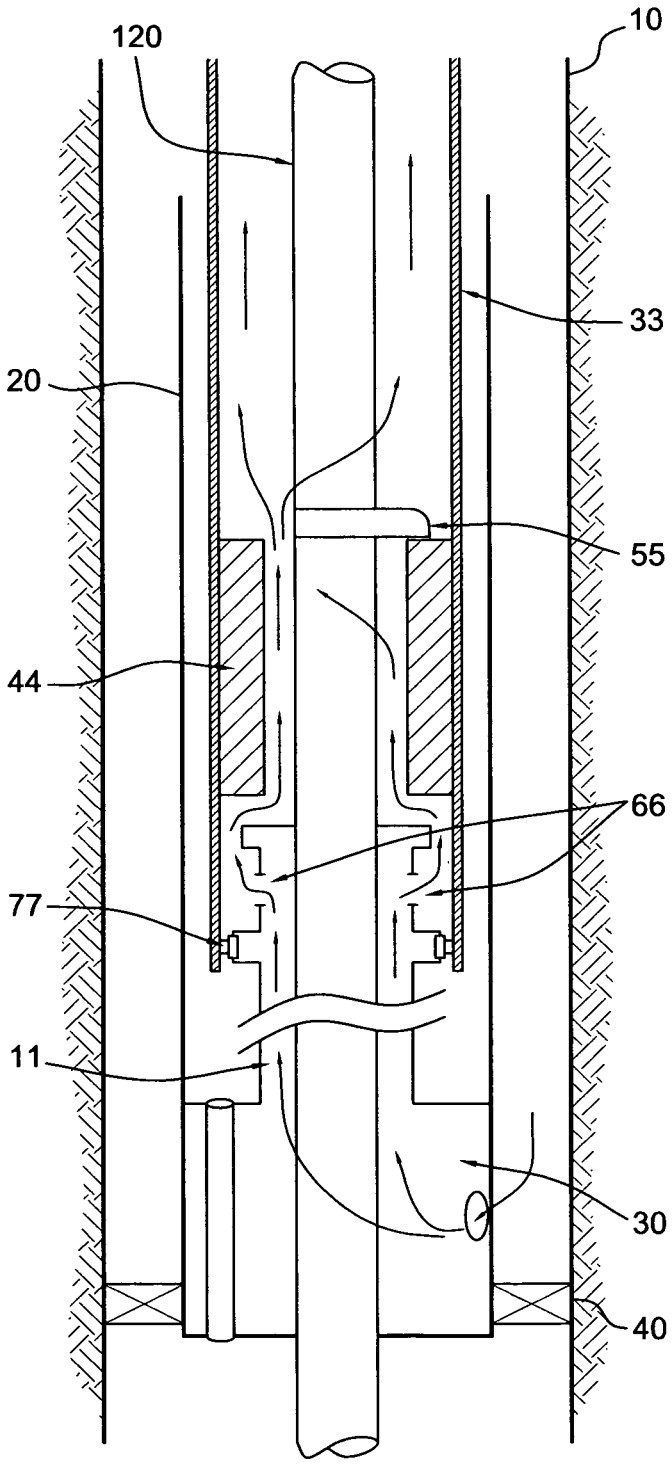
FIG. 4*b* schematically shows additional details of a portion of a pump shown in FIGS. 2 and 3.
Figure 5:
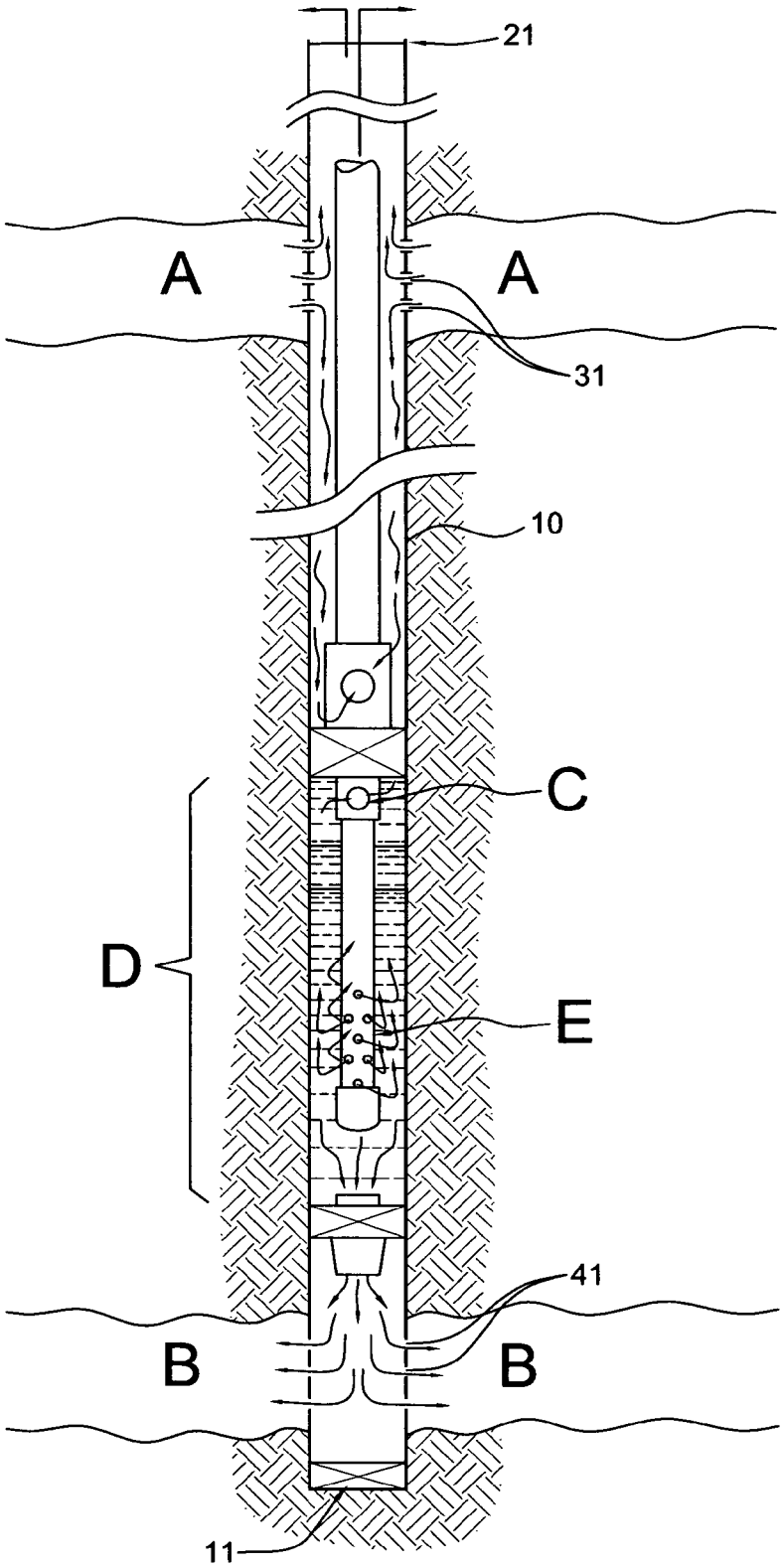
FIG. 5 schematically shows additional details of the system shown in FIG. 1*a*.

As shown in FIG. 4, the oil/water mixture enters the pump through inlets in a bottom manifold 30 positioned adjacent the packer. An inner oil tube passes axially through the pump from the separation zone to the wellhead. A pull tube 11 is positioned radially outward from the inner oil tube and mechanically connected to the bottom manifold 30. As shown by FIG. 5, an outer barrel 20 is positioned radially outward from the pull tube and is mechanically attached to the sucker rod by means of the pull rod. A pump chamber is defined radially from the inner oil tube to the outer barrel, and axially from the standing valve 44 to the upper limit of the outer barrel where it seals against the pull rod. The pump chamber expands and fills during the upstroke, simultaneously forcing fluid existing outside the pump chamber downward through the ports in the bottom in the bottom manifold into the separation chamber. On the down stroke, the seal between the traveling barrel and the pull rod is unseated, the standing valve closes, allowing the fluid within the pump chamber to exhaust upward outside of the pump chamber, and preventing the flow of fluid inside the pump chamber downward through the pull tube. The fluid exits the downflow annular chamber via passages through the bottom manifold 30 and flows into a pump discharge tube extending downwardly through the packer and extending into the separation chamber. The pump discharge tube preferably extends into the separation zone several feet, and is provided with apertures through its sidewall and is sealed at its bottom end to introduce fluids into the separation zone without introducing a lot of turbulence. If desired, the discharge tube and/or annulus between the discharge tube and the casing can be packed with an oil coagulation media, such as a high surface area material formed from polyvinylchloride, polypropylene, or stainless steel.

In operation, an oil phase forms in an upper part of the separation chamber, and a water phase forms in a lower part of the chamber. The oil phase flows from the upper portion of the chamber by the inner tube running through the pump, via one or more inlets opening through the sidewall of the pump discharge tube, by virtue of back pressure caused by the pressure relief valve positioned in the packer at the bottom of the separation chamber. The inner tube generally has an inside diameter in the range of 0.5 inches to 1 inch, to provide adequate flow.

Figure 6:
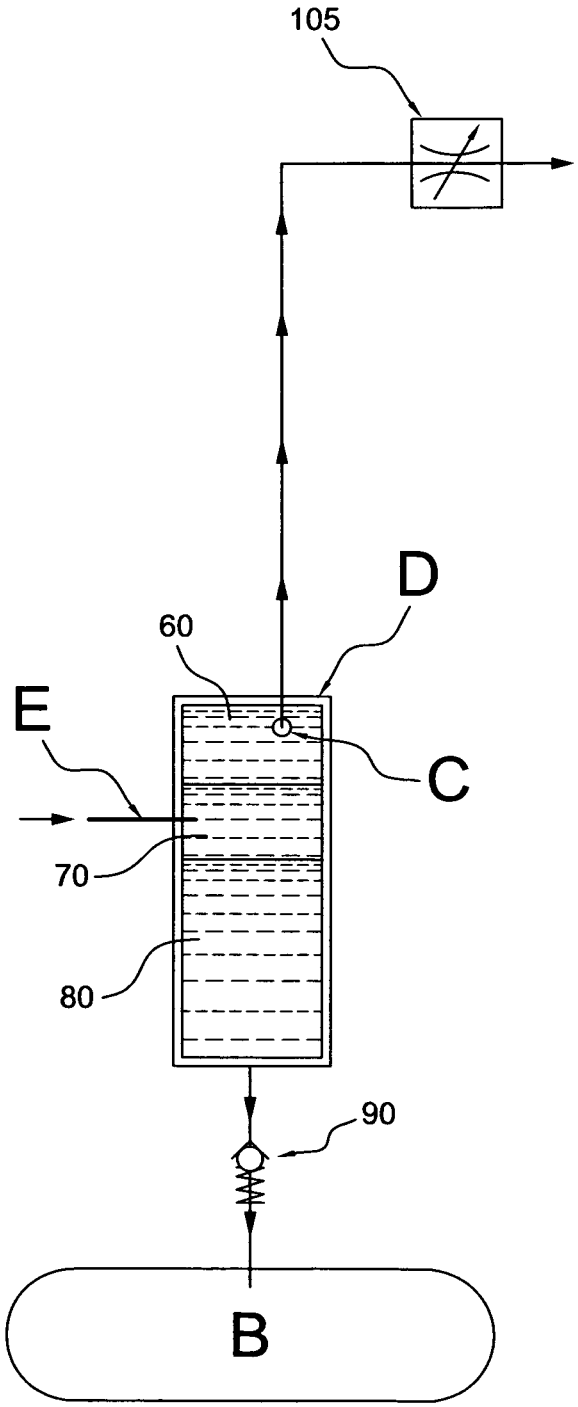
FIG. 6 schematically shows features of a control system according to an embodiment of the invention.

As shown in FIG. 6, a flow restrictor is associated with the inner tube at its upper end. By restricting flow at this point, pressure can be raised in the separation zone which is adequate to unseat the check valve and permit water flow from the bottom of the separation chamber to the disposal zone. Conversely, by opening the restriction, oil flow can be increased, and water flow can be decreased.

To provide automated operation, the oil line at the wellhead is provided with a device to measure the concentration of water contained in the oil, or vice versa. Suitable devices are known. For example, a Red-Eye (R) water cut meter with transmitter is suitable. This device measures the concentration of oil by employing infrared principles. A signal representative of the amount of water in the oil is produced, compared to a set point signal, and a manipulation signal produced in response to the comparison to control. A motor valve is suitably employed as the restriction device for this purpose. By manipulating the valve so as to maintain a small amount of water in the oil, excessive water production at the wellhead, or loss of oil into the disposal zone, can be avoided.

FIG. 1 is a downhole system overview. Oil, gas and water are produced from the production zone A. All three phases enter into the annulus between the casing 10 and tubing 20. Sufficient time is provided between the three phase mixture entering the casing-tubing annulus, and when the mixture enters the barrel seal manifold 30 (BSM 30), to allow the gas to naturally separate and flow to the surface. The two-phase oil and water mixture is pumped past the first packer 40 and exits below it at 50. By means of natural (gravity) separation, the oil and water segregate into 3 distinct sections, oil only 60, oil and water 70 and water only 80. A back pressure valve 90 is utilized to ensure sufficient pressure between the first packer 40 and the second packer 100 to drive the oil into the lower BSM 110, up the inner tube 120, and on to the surface. After passing through the back-pressure valve 90, the water is driven into the disposal zone B.

Alternatively, as shown in FIG. 1*a*, the drop tube 50' can be connected directly to second packer 100' which carries back-pressure valve 90'.

Figure 2:
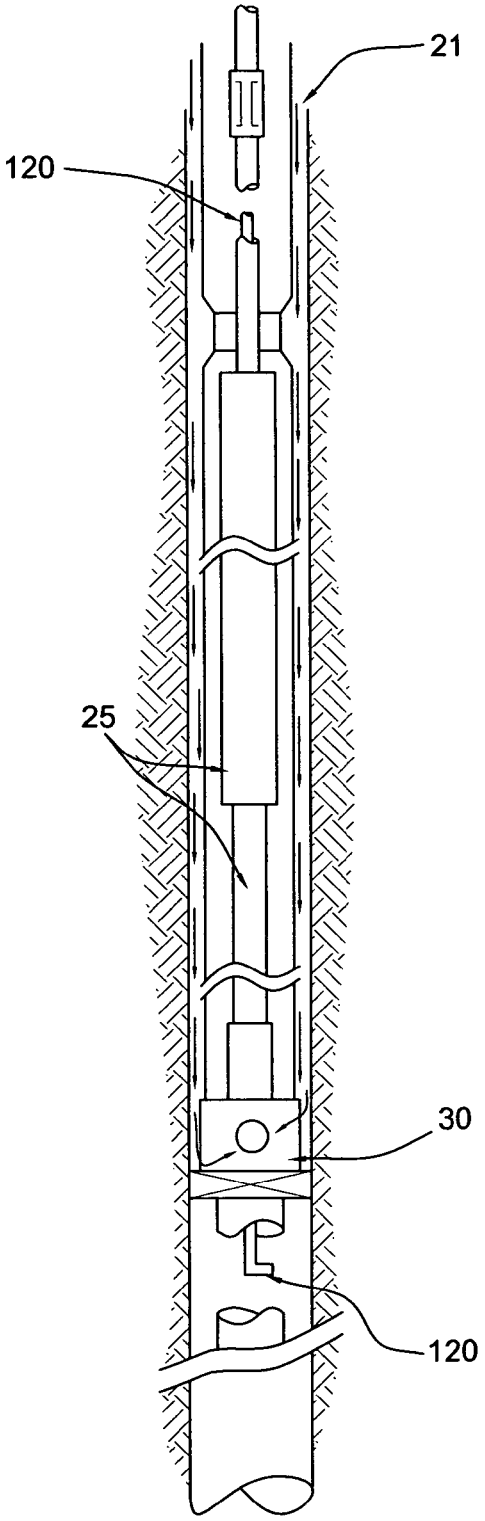
FIG. 2 schematically shows details of a pump according to an embodiment of the invention.

FIG. 2 is a pump detail. FIG. 2 shows the oil and water mixture traveling down the casing-tubing annulus 21. The oil and water enter into the BSM 30 and are drawn into the pump 25.

Figure 3:
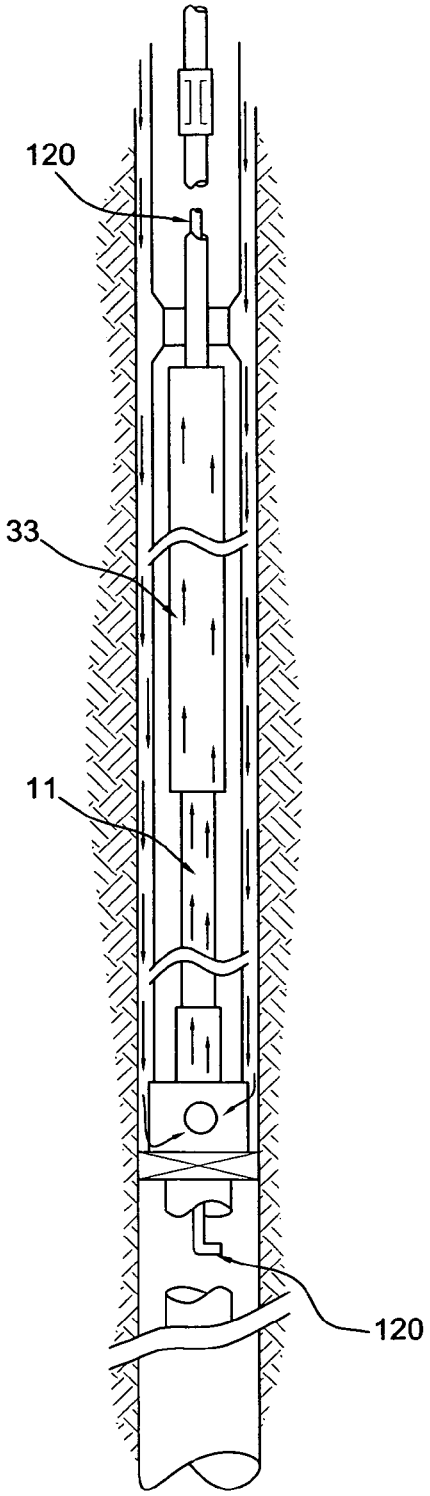
FIG. 3 schematically shows further details of the pump in FIG. 2.

FIG. 3 is a pump detail. As shown in FIG. 3, the fluid mixture then travels up the pump pull tube 11 and into the volume formed inside the pump traveling barrel 33.

FIG. 4 is a pump detail of a pump fill cycle. When the fluid mixture has traveled into the pull tube 11 from the BSM 30, it enters the pump volume. As the traveling barrel 33 moves upward, the standing valve 44 opens. The upward movement of the standing valve is limited by the standing valve stop 55. The fluid inside the pull tube travels past the standing valve, via the pull tube ports 66, and enters the volume created inside the pump during the upstroke. The annular area between the pull tube and the traveling barrel is sealed 77 below the pull tube ports. During the downstroke, the standing valve closes, seating the sealing against the pull tube. This seal prevents fluid within the traveling barrel from traveling back into the BSM 30.

FIG. 5 is a pump detail of a discharge cycle. During the upstroke, the traveling barrel 33 seats against the pull rod 102 and forms a seal, preventing flow from the outside of the traveling barrel to the inside of the traveling barrel. The pump forces the fluid in the volume between the traveling barrel and the tubing 20 down through the bypass chambers in the BSM. The fluid is prevented from traveling up the tubing by the downhole stuffing box (DSB) 54, which seals between the outer surface of the pull rod and the tubing. During the downstroke, the traveling barrel unseats from the pull rod, the standing valve closes (FIG. 4), and the fluid from inside the traveling barrel is displaced to the outside of the traveling barrel. The annular area between the inside of the pull rod and the inner tube is sealed 65.

FIG. 6 shows the relationship between production zone A, disposal zone B, oil intake C, separation chamber D, and pump discharge E.

Figure 7:
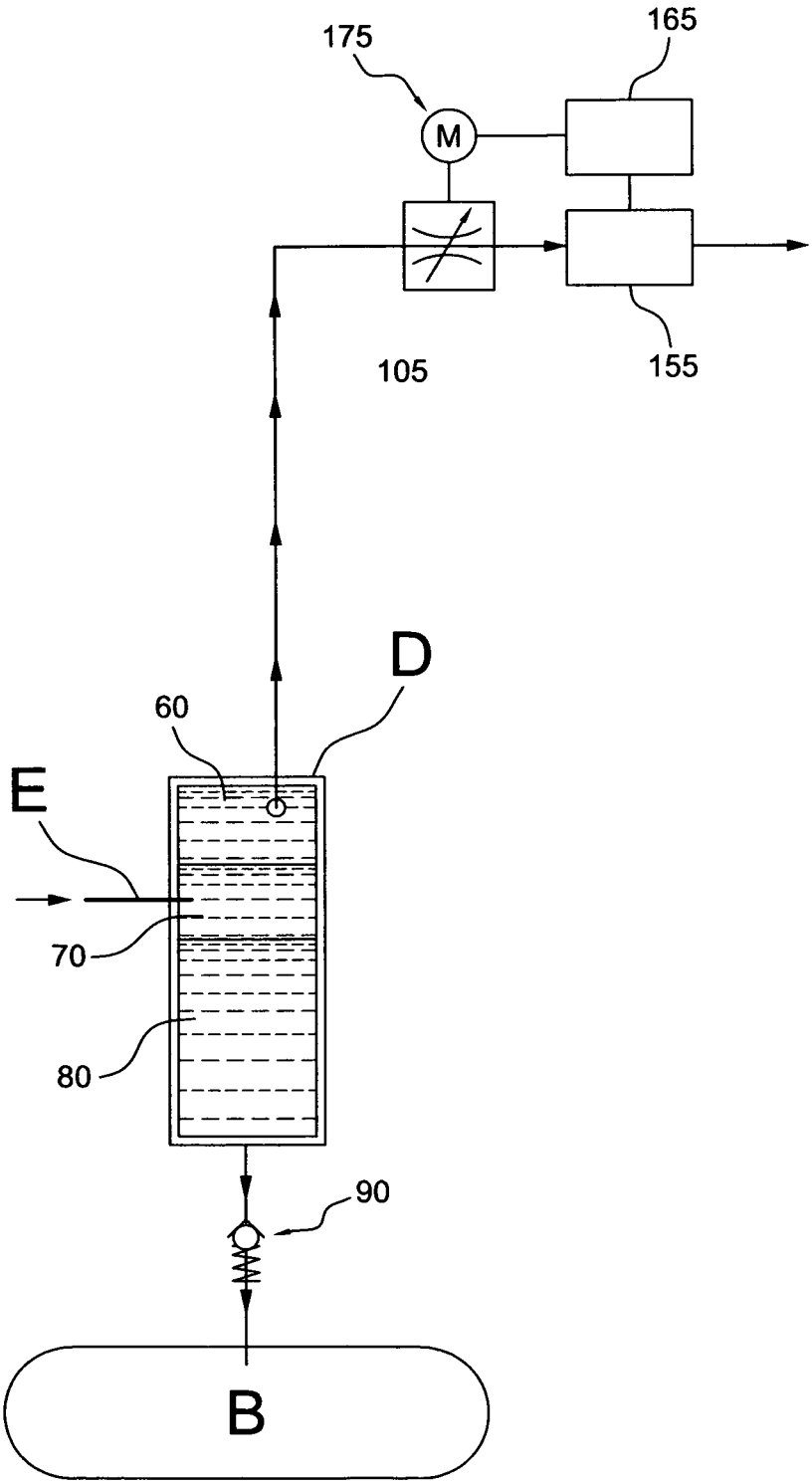
FIG. 7 schematically shows additional features of a control system useful in conjunction with the system of FIG. 5.

FIG. 7 illustrates a control system. The pump discharge E enters into the separation chamber D. As the oil and water separate, three distinct zones form in the separation chamber. Oil on top, water on bottom, and a center zone where it is mixed. The pressure at the pump discharge E is equal to the disposal zone B pressure plus the pressure set on the back-pressure check valve 90. The pressure differential between the pump discharge pressure and the variable restrictor 105 provides the driving force to flow oil to the surface. The flow rate of the oil to the surface is changed by varying the surface restrictor.

Figure 8:
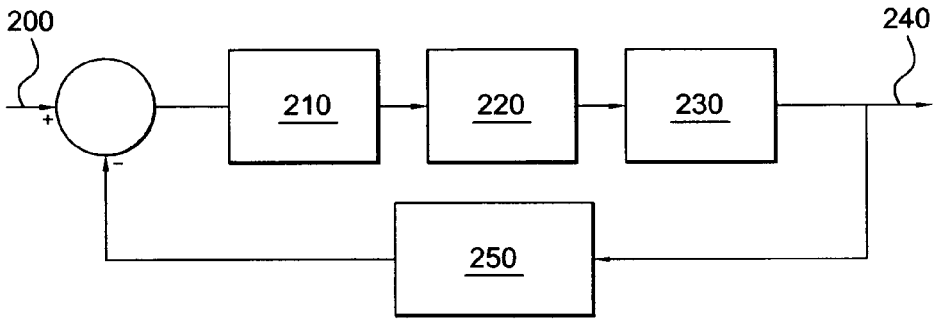
FIG. 8 schematically shows a control logic diagram useful in conjunction with the control systems of FIGS. 5 and 6.

In FIG. 8, pump discharge E is provided at flow rate $Q_P$ and pressure $P_P$. Separation zone D contains oil phase 60, mixture layer 70, and water phase 80. Check valve 90 controls water discharge to disposal zone B at flow rate $Q_W$ and pressure $P_W$. Oil production is regulated by restrictor 105, which is controlled by motor valve M. Motor valve M is controlled by device 155 to measure oil in water and produce a representative signal, with controller 165 to receive the representative signal and vary the signal to motor valve M.

Given sufficient separation chamber volume, the presence of a percentage of water in the oil produced to the surface indicates the relative position of the oil intake to the oil/water interface (mix zone). As the oil/water interface moves upward in the chamber, the amount of water present in the oil will increase. Given this relationship, a control scheme as shown in FIG. 9 will ensure that sufficient oil is produced to the surface. In FIG. 9, signal 200 designates "r=motor signal", box 210 designates "motor manipulates restrictor", box 220 designates "pressure developed at restrictor", box 230 designates "$Q_O$ (oil flow)", line 240 is "oil produced", and box 250 is "presence of water in oil produced". The percentage of water present in the oil produced to the surface provides the feedback for the system. The restrictor is manipulated, via a motor, which changes the flowrate of oil to the surface, thereby influencing the level of the oil/water interface, and changing the percentage of water present in the oil produced to the surface. The process is repeated until the target percentage of water is reached.

The system operates such that only water is pumped into the disposal zone. Two limiting conditions must be satisfied for this system to operate correctly. First, the separation chamber must be large enough to allow sufficient time for the fluid being pumped into it to separate into oil and water. This requirement can be expressed as:

$$V_{CHAMBER}=\text{S.F.}\times Q_{PUMP}\times T_{RETENTION}$$

Where $V_{CHAMBER}$=Volume of Separation Chamber

S.F.=Safety Factor $Q_{PUMP}$=Flowrate of fluid discharged from the pump $T_{RETENTION}$=Retention Time (time required for oil to separate from the water)

Secondly, the flowrate of the oil to the surface must be sufficient so that the oil does not build up in the chamber, causing the oil/water interface (mix zone) to migrate low enough so that oil is pumped to the disposal zone. The ratio f oil produced to the surface, to water disposed, must equal the ratio of oil to water entering the separation chamber. For a given pumping rate, the flow rate of the oil must be controlled via a manipulation of the variable restrictor at the surface. This can be expressed as:

$$Q_{PUMP}=Q_{OIL}+Q_{WATER}$$

$$Q_{OIL}=C\times Q_{PUMP}$$

Where $Q_{WATER}$=Flowrate of water to disposal zone $Q_{OIL}$=Flowrate of oil produced at surface C=(volume of oil/volume of total fluid) as discharged from the pump $Q_{PUMP}$=Flowrate of fluid discharged from the pump Furthermore, "C" and $Q_{PUMP}$ are known. "C", also referred to as "cut", is a function of the reservoir (production zone) and "$Q_{PUMP}$" is determined from the pumping parameters.

One embodiment of the invention provides a method for controlling the degree of oil/water separation achieved in a process for separating oil/water/gas phases downhole. A mixture of oil, gas and water is produced in a first section of a cased well. The gas is separated from the mixture and withdrawn from an upper end of the first section. A mixture of oil and water is collected at a lower end of the first section. The collected mixture of oil and water is pumped from the lower end of the first section into a second section positioned beneath the first section. In the second section, the oil phase is separated from the water phase. The second section is maintained at adequate pressure to flow the oil phase to the wellhead and the oil phase flows up a tubing to the wellhead to produce the oil. The produced oil is analyzed for entrained water droplets. An electronic signal representative of the amount of water in the produced oil is produced. A valve operably associated with the tubing is then manipulated responsively to said electronic signal to maintain the amount of water in the produced oil within predetermined lower and upper limits.

Another embodiment of the invention provides a method for controlling the pressure available downhole to produce the oil phase from an oil/gas/water separation conducted downhole. A mixture of oil, gas and water is produced in a first section of a cased well. The gas is separated from the mixture, the separated gas is withdrawn from an upper end of the first section, and a mixture of oil and water is collected at a lower end of the first section. The collected mixture of oil and water is pumped from the lower end of the first section into a second section positioned beneath the first section. A valve is positioned at the lower end of the second section. The valve is set to provide adequate pressure in the second section to flow the oil phase to the wellhead. The oil phase is separated from the water phase in the second section and flowed up the tubing to the wellhead where it is produced.

Another embodiment of the invention provides a method for facilitating oil/water separation in an oil/gas/water separation conducted downhole. A mixture of oil, gas and water is produced in a first section of a cased well. The gas is separated from the mixture and the separated gas is withdrawn from an upper end of the first section. A mixture of oil and water is collected at a lower end of the first section. The collected mixture of oil and water is pumped from the lower end of the first section into a second section positioned beneath the first section. In the second section the oil phase is separated from the water phase. The improvement is to establish an environment in the second section to facilitate phase separating the oil phase from the water phase, for example, by introducing phase separation chemicals into the second section, or by positioning a coagulation media in the second section to facilitate separating the oil phase from the water phase.

What is claimed is:

1. Apparatus for the production of hydrocarbons, said apparatus comprising a wellbore extending into the earth from a wellhead positioned at the surface of the earth, a casing defined by a tubular casing sidewall lining the wellbore, a set of production perforations though the casing sidewall at a first longitudinal position establishing communication between a hydrocarbon production zone and an inside of the casing, a set of disposal perforations through the casing sidewall at a second longitudinal position establishing communication between an inside of the casing and a waste water disposal zone, wherein the set of production perforations is spaced apart from the set of disposal perforations and is positioned between the set of disposal perforations and the wellhead, a pump assembly positioned inside of the casing and including a seal assembly sealed against the tubular casing sidewall at a seal location between the set of production perforations and the set of disposal perforations, said pump assembly having an intake positioned to draw fluid from the inside of the casing above the seal location and a discharge to discharge fluid through the seal assembly and into the inside of the casing below the seal location;

a packer positioned inside of the casing between the seal assembly and the disposal perforations, said packer having a passage extending through it, a separation chamber for phase separating oil from water being defined in the casing between the seal assembly and the packer, a settable pressure-relief check valve operatively associated with the passage extending through the packer, said settable pressure-relief check valve unseating in response to a pressure difference across the pressure-relief check valve to permit waste water flow from the bottom of the separation chamber to the set of disposal perforations, said settable pressure-relief check valve being set to create sufficient back pressure in the separation chamber to drive oil to the wellhead;

a tubing extending from an upper end of the separation chamber to the wellhead, said tubing forming a flow path for oil between the separation chamber and the wellhead, and a variable flow restrictor operatively associated with the tubing forming the flow path for oil at a location on the surface near the wellhead for restricting oil flow through the tubing sufficiently to unseat the settable pressure-relief check valve and provide for the disposal of waste water through the set of disposal perforations.

2. Apparatus as in claim 1 further comprising a control system operatively associated with the variable flow restrictor for opening the variable flow restrictor in response to a decrease in water concentration in fluid carried by the tubing and closing the variable flow restrictor in response an increase in water concentration in fluid carried by the tubing to maintain the concentration of water in the fluid within predetermined lower and upper limits.

3. Apparatus as in claim 1 further comprising coagulation media positioned in the separation chamber.

4. Apparatus as in claim 1 wherein the seal assembly comprises a second packer sealed against the tubular casing sidewall, a bottom seal manifold carried by the second packer, said bottom seal manifold defining both the pump intake and the pump discharge.

5. Apparatus as in claim 4 further comprising a drop tube extending downwardly from the bottom seal manifold in flow communication with the pump discharge, said drop tube forming a discharge into the separation zone.

6. Apparatus as in claim 1 wherein the tubing extending from an upper end of the separation chamber to the wellhead is located along an axis of the wellbore.

7. Apparatus for the production of hydrocarbons, said apparatus comprising a wellbore extending into the earth from a wellhead positioned at the surface of the earth, a casing defined by a tubular casing sidewall lining the wellbore, a set of production perforations though the casing sidewall a first longitudinal position establishing communication between a hydrocarbon production zone and an inside of the casing, a set of disposal perforations through the casing sidewall at a second longitudinal position establishing communication between an inside of the casing and a waste water disposal zone, wherein the set of production perforations is spaced apart from the set of disposal perforations and is positioned between the set of disposal perforations and the wellhead, a pump assembly positioned inside of the casing and including a seal assembly sealed against the tubular casing sidewall at a seal location between the set of production perforations and the set of disposal perforations, said pump assembly having an intake positioned to draw fluid from the inside of the casing above the seal location and a discharge to discharge fluid through the seal assembly and into the inside of the casing below the seal location;

a packer positioned inside of the casing between the seal assembly and the disposal perforations, said packer having a passage extending through it a separation chamber for phase separating oil from water being defined in the casing between the seal assembly and the packer, a pressure-relief check valve operatively associated with the passage extending through the packer, said pressure-relief check valve unseating in response to a pressure difference across the pressure-relief check valve to permit waste water flow from the bottom of the separation chamber to the set of disposal perforations, said pressure-relief check valve creating sufficient back pressure in the separation chamber to drive oil to the wellhead;

a tubing extending from an upper end of the separation chamber to the wellhead, said tubing forming a flow path for oil between the separation chamber and the wellhead, and a variable flow restrictor operatively associated with the tubing forming the flow path for oil at a location on the surface near the wellhead for restricting oil flow through the tubing sufficiently to unseat the pressure relief check valve and provide for the disposal of waste water through the set of disposal perforations;

wherein the pump assembly comprises an outer housing positioned in the well casing, an annulus being defined between the well casing and the outer housing, a pump traveling barrel positioned in the outer housing, said pump traveling barrel having an upper end and a lower end, said pump traveling barrel being partly closed at its upper end by an annular wall, a pump pull rod having a portion positioned in the pump traveling barrel and a portion extending from the upper end of the pump traveling barrel, said pump pull rod having a bottom end and a radially outwardly extending wall from its lower end which seals against the annular wall at the upper end of the pump traveling barrel when the pump pull rod is pulled upwardly, said pump pull rod further having at least one radial outward protrusion spaced apart from its lower end to urge the traveling barrel downwardly, wherein a first pump chamber is defined inside of the traveling barrel and a second pump chamber is defined outside of the pump traveling barrel between an upper end of the pump traveling barrel and an upper end of the outer housing, an annulus for downflow of fluid being defined between the outside of the traveling barrel and the inside of the outer housing, wherein upstroke on the pull rod expands the first pump chamber and draws fluid in through the pump intake, while simultaneously compressing the second pump chamber and forcing fluid down the annulus between the outside of the traveling barrel and the housing and out the pump discharge.

8. Apparatus as in claim 7 wherein the pump assembly further comprises an axial pull tube extending upwardly from the bottom seal manifold, an inside of the axial pull tube being in flow communication with the pump intake, said axial pull tube having an upper end forming a valve face and at least one radial port spaced apart from the upper end forming a flow path between the inside of the axial pull tube and an annulus between the outside of the axial pull tube and the inside of the pump traveling barrel, an annular seal mounted to an outside surface of the axial pull tube slidably sealingly engaged with an inner surface of the pump traveling barrel, and an annular standing valve mounted to an inside of the pump traveling barrel for sealing against the valve face at the upper end of the axial pull tube when the pump traveling barrel is urged down.

* * * * *